US008911923B2

(12) United States Patent
Iida et al.

(10) Patent No.: US 8,911,923 B2
(45) Date of Patent: Dec. 16, 2014

(54) TONER FOR DEVELOPING ELECTROSTATIC CHARGE IMAGE, ELECTROSTATIC CHARGE IMAGE DEVELOPER, TONER CARTRIDGE, DEVELOPER CARTRIDGE, PROCESS CARTRIDGE, IMAGE FORMING APPARATUS, AND IMAGE FORMING METHOD

(75) Inventors: Yoshifumi Iida, Kanagawa (JP); Eiji Kawakami, Kanagawa (JP); Shintaro Anno, Kanagawa (JP); Masahiro Takagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 42 days.

(21) Appl. No.: 13/565,200

(22) Filed: Aug. 2, 2012

(65) Prior Publication Data

US 2013/0252164 A1 Sep. 26, 2013

(30) Foreign Application Priority Data

Mar. 23, 2012 (JP) ..... 2012-067650

(51) Int. Cl.
*G03G 9/087* (2006.01)

(52) U.S. Cl.
USPC ..... 430/108.11; 430/108.6; 430/108.7; 430/123.51

(58) Field of Classification Search
USPC ..... 430/108.11, 108.7, 108.6, 123.51; 399/252
See application file for complete search history.

(56) References Cited

U.S. PATENT DOCUMENTS

| | | | | |
|---|---|---|---|---|
| 4,868,084 | A | 9/1989 | Uchide et al. | |
| 4,906,548 | A | 3/1990 | Uchide et al. | |
| 5,534,981 | A * | 7/1996 | Ohno et al. | 399/252 |
| 5,849,451 | A * | 12/1998 | Ishihara et al. | 430/108.11 |
| 6,534,229 | B2 * | 3/2003 | Ohba et al. | 430/108.2 |
| 7,759,038 | B2 * | 7/2010 | Yamazaki et al. | 430/108.11 |
| 2006/0045571 | A1 * | 3/2006 | Matsuura et al. | 399/149 |
| 2009/0142110 | A1 * | 6/2009 | Oya et al. | 399/320 |
| 2009/0214966 | A1 * | 8/2009 | Kishida | 430/48 |
| 2010/0015543 | A1 * | 1/2010 | Oki et al. | 430/108.22 |
| 2011/0217643 | A1 * | 9/2011 | Ishizuka | 430/105 |

FOREIGN PATENT DOCUMENTS

| | | |
|---|---|---|
| JP | A-49-91231 | 8/1974 |
| JP | A-56-40868 | 4/1981 |
| JP | A-63-139367 | 6/1988 |
| JP | A-63-139369 | 6/1988 |
| JP | A-2008-158442 | 7/2008 |
| JP | A-2008-209489 | 9/2008 |
| JP | A-2008-233736 | 10/2008 |
| JP | A-2010-160325 | 7/2010 |

OTHER PUBLICATIONS

Diamond, A.S., et al., ed., Handbook of Imaging Materials, Second Edition, Marcel Dekker, Inc., NY (2002), pp. 146-148.*

* cited by examiner

*Primary Examiner* — Janis L Dote
(74) *Attorney, Agent, or Firm* — Oliff PLC

(57) ABSTRACT

The toner for developing an electrostatic charge image includes toner particles containing a colorant, a binder resin, and a release agent, and an external additive, wherein the external additive contains inorganic particles having fluorine atom-containing oil on the hydrophobization-treated surfaces.

12 Claims, No Drawings

TONER FOR DEVELOPING ELECTROSTATIC CHARGE IMAGE, ELECTROSTATIC CHARGE IMAGE DEVELOPER, TONER CARTRIDGE, DEVELOPER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2012-067650 filed Mar. 23, 2012.

BACKGROUND

1. Technical Field

The present invention relates to a toner for developing an electrostatic charge image, an electrostatic charge image developer, a toner cartridge, a developer cartridge, a process cartridge, an image forming apparatus, and an image forming method.

2. Related Art

A method for visualizing image information via an electrostatic charge image, such as electrophotography, is currently used in a variety of fields. In electrophotography, an electrostatic charge image (electrostatic latent image) is formed on a photoreceptor (image holding member) by charging and exposing, and the electrostatic latent image is visualized by developing by a developer including a toner, and transferring and fixing the image. The developer used in this development includes a two-component developer containing a toner and a carrier, and a single-component developer using a magnetic toner or non-magnetic toner. Here, as a preparation method for the toner, a kneading pulverizing preparation method in which a thermoplastic resin is melt-kneaded with a pigment, a charge-controlling agent, or a release agent such as a wax, and cooled, and then the mixture is finely milled and then classified, is usually used. For these toners, inorganic or organic particles for improving the fluidity or cleaning property may be added to the surface of the toner particles, if desired, in some cases.

SUMMARY

According to an aspect of the invention, there is provided a toner for developing an electrostatic charge image including toner particles containing a colorant, a binder resin, and a release agent, and an external additive, wherein the external additive contains inorganic particles having fluorine atom-containing oil on the hydrophobization-treated surfaces.

DETAILED DESCRIPTION

Hereinbelow, the present exemplary embodiments will be described.

Toner for Developing Electrostatic Charge Image

The toner for developing an electrostatic charge image of the present exemplary embodiment (which will also be hereinafter simply referred to as a "toner") includes toner mother particles containing a colorant, a binder resin, and a release agent, and an external additive, wherein the external additive contains particles having hydrophobization-treated surfaces, and the surfaces of the particles having hydrophobization-treated surfaces further have fluorine atom-containing oil.

The present inventors have found that charge reduction with the passage of time (charge decay when being left to stand) occurs to a remarkable extent with an external additive using an oil external treatment additive, in particular, silicone oil, under a high temperature and high humidity environment. It is thought that a presumed mechanism for this decay when being left to stand depends on the absorption amount of the silicone oil. Generally, the absorption amount of the silicone oil is about 200 ppm. It is presumed that charge leaks from the moisture to cause the charge decay. In this state, it is presumed that free silicone oil is used to perform image formation, the oil is attached to the toner surface, and further, the toner surface in turn becomes in a state of being coated with silicone oil. When the toner surface is exposed as coated with the oil under a high temperature and high humidity environment, the silicone oil absorbs water on the outermost surface of the toner to form a film of water molecules, and the charges leak from the toner surface to enhance the charge reduction.

In this regard, the present inventors have made extensive studies, and as a result, they have found that by using fluorine atom-containing oil on the surface of the hydrophobization-treated particles, from the viewpoints that the water repellency of the toner increases (the water content of the fluorine atom-containing oil is remarkably lower than that of the silicone oil), and further, the fluorine atom-containing oil is coated on the photoreceptor, and particularly, filming occurs in an image portion, generation of filming in the image portion is suppressed by incorporating fluorine atom-containing oil components into the toner.

Furthermore, the present inventors have found that by incorporating fluorine atom-containing oil into the surface of the hydrophobization-treated particles, the oil is attached to the photoreceptor and the carrier, and the portion to which the fluorine atom-containing oil is attached has increased water repellency, and thus, charge reduction with the passage of time (charge decay when left to stand) is suppressed even under a high temperature and high humidity environment.

External Additive

The toner for developing an electrostatic charge image of the present exemplary embodiment contains toner mother particles and an external additive, the external additive contains particles having hydrophobization-treated surfaces, and the surfaces of the particles having hydrophobization-treated surfaces further have fluorine atom-containing oil thereon. Further, a particle having a hydrophobization-treated surface and further having fluorine atom-containing oil in the surface is also referred to as a specific external additive.

In the specific external additive, the fluorine atom-containing oil may be included in at least a part of the outermost surfaces of the particles, but equal to or more than 50% by area of the outermost surfaces of the particles are preferably coated with fluorine atom-containing oil, and equal to or more than 80% by area of the outermost surfaces of the particles are more preferably coated with fluorine atom-containing oil.

The coating amount of the fluorine atom-containing oil is measured by dying the fluorine atom-containing oil with a dying agent such as an organic compound and a fluorine compound, photographing a toner or the particles, analyzing the image, and calculating an average value of 50 or more particles.

Furthermore, the fluorine atom-containing oil may be attached on the surfaces of the particles by physical adsorption or by bonding to the surfaces of the particles via chemical bonds, but the fluorine atom-containing oil is preferably physically adsorbed on the surfaces of the particles. In the exemplary embodiment, the charging stability under a high temperature and high humidity environment is superior. Further, in the case where the fluorine atom-containing oil is physically adsorbed, when the toner is used, a part of the fluorine atom-containing oil becomes free or directly adhered to a carrier, a photoreceptor, or the like, from the particles and accordingly, generation of filming and charge reduction of the toner with the passage of time under a high temperature and high humidity environment is suppressed.

At least a part of the surfaces of the particles in the specific external additive may be hydrophobization-treated, but it is preferable that equal to or more than 50% by area of the surfaces of the particles be hydrophobization-treated, and it is more preferable that equal to or more than 80% by area of the outermost surfaces of the particles be hydrophobization-treated.

Examples of a method for measuring the hydrophobization-treated area in the particles include a method in which the fluorine atom-containing oil is removed with a solvent or a liquid containing a surfactant, the hydrophobization-treatment agent-derived hydrocarbon group or nitrogen atom of the surfaces of the particles is then dyed with a dying agent, the dyed particles are photographed, the image is analyzed, and an average value of 50 or more particles is calculated.

Furthermore, in the hydrophobization treatment, the hydrophobization treatment agent is preferably bonded to the surfaces of the particles via chemical bonds.

Particles Having Hydrophobization-Treated Surfaces

The particles in the specific external additive are not particularly limited, and as the external additive of the toner, known inorganic particles and organic particles are used, examples of which include inorganic particles such as silica, alumina, titanium oxide (for example, titanium oxide and metatitanic acid), cerium oxide, zirconia, calcium carbonate, magnesium carbonate, calcium phosphate, and carbon black, and resin particles such as vinyl resins, polyester resins, and silicone resins.

Among these, inorganic particles are preferred, silica particles or titanium oxide particles are more preferred, and silica particles are particularly preferred.

Examples of the silica particles include silica particles of fumed silica, colloidal silica, silica gel, or the like.

Furthermore, the particles are particles formed by subjecting the surfaces or at least a part thereof to hydrophobization treatment. By subjecting the particles to hydrophobization treatment, the charge reduction of the toner under a high temperature and high humidity environment is suppressed.

The hydrophobization treatment may be carried out by, for example, dipping the inorganic particles in a hydrophobization treatment agent. The hydrophobization treatment agent is not particularly limited, but examples thereof include hexamethyldisilazane (HMDS), a silane coupling agent, a titanate coupling agent, and an aluminum coupling agent. These may be used singly or in combination of two or more kinds thereof. Among these, hexamethyldisilazane and a silane coupling agent are preferred.

As the silane coupling agent, any type of, for example, chlorosilane, alkoxysilane, or silazane, and a specific silylating agent may be used.

Specific examples of the silane coupling agent include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,O-(bistrimethylsilyl)acetoamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane.

Although the amount of the hydrophobization treatment agent varies depending on the kind or the like of the particles and may not be simply defined, it is preferably from 1 part by weight to 50 parts by weight, more preferably 5 parts by weight to 40 parts by weight, and still more preferably 10 parts by weight to 30 parts by weight, with respect to 100 parts by weight of the particles. Further, in the present exemplary embodiment, commercially available products as the hydrophobized silica particles that have been subjected to hydrophobization treatment are also preferably used.

Fluorine Atom-Containing Oil

The fluorine atom-containing oil used in the present exemplary embodiment is not particularly limited, but from the viewpoints of charging stability under a high temperature and high humidity environment, and filming suppression, the kinetic viscosity at 20° C. is preferably equal to or less than 1,000 cSt, and more preferably equal to or less than 800 cSt.

As the fluorine atom-containing oil used in the present exemplary embodiment, a compound having at least a perfluoroalkyl group and/or a perfluoroalkylene group is preferred, perfluoropolyether, polyhexafluoropropylene epoxide, polytrifluorochloroethylene, polytetrafluoroethylene, perfluorocarbon, or modified ones thereof is more preferred, perfluoropolyether, polyhexafluoropropylene epoxide, polytrifluorochloroethylene, polytetrafluoroethylene, or perfluorocarbon is still more preferred, and perfluoropolyether, or polyhexafluoropropylene epoxide is particularly preferred.

As the fluorine atom-containing oil used in the present exemplary embodiment, a commercially available product may be used, and examples thereof include KRYTOX Series (manufactured by DuPont Kabushiki Kaisha), GALDEN Series and FOMBLIN Series, both manufactured by Solvay Solexis, Inc., DEMNUM Series and DAIFLOIL Series, both manufactured by Daikin Industries, Ltd., BARRIERTA Series manufactured by NOK Klüber Corporation, and FLUORINERT Series manufactured by 3M Corp.

The number average molecular weight of the fluorine atom-containing oil is preferably from 300 to 100,000, more preferably from 500 to 20,000, and still more preferably from 500 to 10,000. In the exemplary embodiment, under a high temperature and high humidity environment, generation of filming is further suppressed.

The fluorine atom-containing oil may be used singly or in combination of two or more kinds thereof.

Furthermore, the toner of the present exemplary embodiment may have one kind or two or more kinds of specific external additives as the external additive.

The volume average primary particle diameter of the particles of the specific external additive, the particles having hydrophobization-treated surfaces in the specific external additive, or the like is preferably from 3 nm to 500 nm, more preferably from 7 nm to 300 nm, still more preferably from 20 nm to 200 nm, and particularly preferably from 40 nm to 130 nm. Within these ranges, the transfer properties of the fluorine atom-containing oil to a carrier, a photoreceptor, or the like are excellent, and thus, generation of filming under a high temperature and high humidity environment is further suppressed.

The volume average primary particle diameter of the particles is preferably measured by, for example, LS 13320 (manufactured by Beckman Coulter, Inc.).

Furthermore, in the toner of the present exemplary embodiment, the volume average primary particle diameter of the specific external additive is preferably larger than the volume average primary particle diameter of the external additive other than the specific external additive.

In the toner of the present exemplary embodiment, the content of the specific external additive is not particularly limited, but it is preferably from 0.3% by weight to 10% by weight, more preferably from 0.5% by weight to 5% by weight, and still more preferably from 0.8% by weight to 2.0% by weight, with respect to the total weight of the toner.

The content of the fluorine atom-containing oil is preferably in the range of 1 part by weight to 30 parts by weight with respect to 100 parts by weight of the inorganic particles.

The weight ratio of the hydrophobization treatment agent to the fluorine atom-containing oil is in the range of 1:30 to 50:1.

Method for Preparing Particles Having Fluorine Atom-Containing Oil on Outermost Surfaces (Surface Treatment Method)

The method for preparing particles having fluorine atom-containing oil on the outermost surfaces is not particularly limited, but a known method is used. Further, it is not necessary to carry out a chemical treatment, and even in the state where the fluorine atom-containing oil is physically adsorbed on the outermost surfaces of the particles, the effect of the present exemplary embodiment is sufficiently exhibited.

Examples of the method for a physical adsorption treatment include a drying method by, for example, a spray-drying process in which fluorine atom-containing oil or a liquid containing fluorine atom-containing oil is sprayed onto particles having hydrophobization-treated surfaces that float in the air; and a method in which particles having hydrophobization-treated surfaces are dipped in a liquid containing fluorine atom-containing oil, and then dried. Further, particles that have been subjected to a physical adsorption treatment may be heated to allow the fluorine atom-containing oil to be chemically bonded to the outermost surfaces of the particles.

In the toner of the present exemplary embodiment, the treatment amount of the fluorine atom-containing oil for the particles (the content of the fluorine atom-containing oil in the toner) is preferably from 1% by weight to 30% by weight, more preferably from 5% by weight to 20% by weight, and still more preferably from 7% by weight to 15% by weight, with respect to the total weight of the external additive. Within these ranges, generation of filming under a high temperature and high humidity environment is suppressed.

Examples of the method for external addition of the external additive in the toner of the present exemplary embodiment include a method in which toner mother particles and an external additive are mixed using, for example, a HENSCHEL mixer or a V BLENDER for preparation. Further, when the toner mother particles are prepared by a wet method, the external additive may be added by a wet method.

Other examples of such a method include a method in which particles are externally added to toner mother particles, then fluorine atom-containing oil or a liquid containing fluorine atom-containing oil is added thereto, and the mixture is stirred using, for example, a HENSCHEL mixer or a V BLENDER for preparation.

Among these, as the method for preparing the particles having fluorine atom-containing oil on the outermost surfaces, a preparation method using a physical adsorption treatment is preferred.

Other External Additives

The toner of the present exemplary embodiment may include an external additive other than the specific external additive (which is also referred to as "other external additive").

The content of such other external additive in the toner of the present exemplary embodiment may be less than that of the specific external additive.

Examples of other external additive include inorganic particles or organic particles as described above.

The inorganic particles in the other external additives may be preferably subjected to a hydrophobization treatment on the surfaces in advance. This hydrophobization treatment is effective in terms of dependency of the charging on the environment and the antifouling properties of a carrier in addition to improvement of powder fluidity of a toner. As the hydrophobization treatment, the above-described method may be preferred.

The volume average primary particle diameter of other external additives may be selected from a range of 3 nm to 500 nm, according to, for example, the fluidity, charging characteristics, or cleaning properties.

[Toner Mother Particles]

The toner for developing an electrostatic charge image of the present exemplary embodiment contains toner mother particles containing a colorant, a binder resin, and a release agent. Further, the toner mother particles may further contain known additives such as a charge-controlling agent.

Binder Resin

As the binder resin, polyolefin resins such as polyethylene and polypropylene, styrene resins having, for example, polystyrene or poly(α-methylstyrene), (meth)acryl resins having, for example, polymethylmethacrylate or polyacrylonitrile as a major component, styrene-(meth)acrylate copolymer resins, polyamide resins, polycarbonate resins, polyether resins, polyester resins, and copolymer resins thereof may be used, but from the viewpoint of the charging stability or development durability in the use thereof as a toner for developing an electrostatic charge image, styrene resins, (meth)acryl resins, styrene-(meth)acrylate copolymer resins, and polyester resins are preferred.

As the binder resin, from the viewpoint of low-temperature fixing properties, polyester resins are preferably contained, and amorphous (non-crystalline) polyester resins are more preferably contained.

The polyester resins are usually ones obtained by, for example, a polycondensation reaction of polyvalent carboxylic acids and polyols.

Examples of the polyvalent carboxylic acid include aromatic carboxylic acids such as terephthalic acid, isophthalic acid, phthalic anhydride, trimellitic anhydride, pyromellitic acid, and naphthalene dicarboxylic acid, aliphatic carboxylic acids such as maleic anhydride, fumaric acid, succinic acid, alkenyl succinic anhydride, and adipic acid, alicyclic carboxylic acids such as cyclohexanedicarboxylic acid, and lower alkyl esters or acid anhydrides thereof. Further, the lower alkyl represents a linear, branched, or cyclic alkyl group having 1 to 8 carbon atoms. These polyvalent carboxylic acids may be used singly or in combination of two or more kinds thereof. Among these polyvalent carboxylic acids, aromatic carboxylic acids are preferably used. Further, for the purpose of securing good fixing properties, it is preferable to use a dicarboxylic acid in combination with a trivalent or higher carboxylic acid (trimellitic acid or an acid anhydride thereof, or the like) to form a crosslinking structure or branched structure.

Examples of the polyvalent carboxylic acid used to obtain an amorphous polyester resin include aromatic dicarboxylic acids such as phthalic acid, isophthalic acid, terephthalic acid, naphthalene-2,6-dicarboxylic acid, 1,4-phenylene diacetic acid, and 1,4-cyclohexanedicarboxylic acid, and dicarboxylic acids having an alicyclic hydrocarbon group, as well as acid anhydrides and lower alkyl esters thereof.

Examples of the polyol include aliphatic diols such as ethylene glycol, diethylene glycol, triethylene glycol, propylene glycol, butanediol, hexanediol, neopentyl glycol, and glycerin, alicyclic diols such as cyclohexanediol, cyclohexanedimethanol, and hydrogenated bisphenol A, and aromatic diols such as an ethylene oxide adduct of bisphenol A and a propylene oxide adduct of bisphenol A. These polyols may be used singly or in combination of two or more kinds thereof.

Examples of the polyol used to obtain an amorphous polyester preferably include aliphatic, alicyclic, and aromatic polyols. Specific examples thereof include 1,4-cyclohexanediol, 1,4-cyclohexanedimethanol, an alkylene oxide adduct of bisphenol A, an alkylene oxide adduct of bisphenol Z, and an alkylene oxide adduct of hydrogenated bisphenol A. Among these, the alkylene oxide adduct of bisphenol A may be preferably used, and an ethylene oxide 2-mol adduct of bisphenol A and a propylene oxide 2-mol adduct of bisphenol A may be more preferably used.

Furthermore, for the purpose of securing good fixing properties, a diol may be used in combination with a trivalent or higher polyol (for example, glycerin, trimethylolpropane, and pentaerythritol) to give a crosslinked structure or a branched structure.

The glass transition temperature (which may be abbreviated as "Tg" in some cases) of the amorphous polyester resin is preferably from 50° C. to 80° C., and more preferably from 50° C. to 70° C. A Tg of equal to or lower than 80° C. is preferred since the low-temperature fixing properties are excellent. Further, a Tg of equal to or higher than 50° C. is also preferred since the heat resistance and storability as well as storability of a fixed image are excellent.

The acid value of the amorphous polyester resin is preferably from 5 mg KOH/g to 25 mg KOH/g, and more preferably from 6 mg KOH/g to 23 mg KOH/g. When the acid value is equal to or less than 5 mg KOH/g, the affinity of the toner to paper is good and the charging properties are also good. Further, in the case where a toner is prepared by an emulsion aggregation method as described later, emulsified particles are easily prepared, and further the aggregation speed in the aggregation in the emulsion aggregation method or the shape changing speed in the coalescence is inhibited from being remarkably increased, and thus, it is easy to carry out regulation of particle size control or shape control. Further, if the acid value of the amorphous polyester resin is equal to or less than 25 mg KOH/g, the dependency of the charging on the environment is not adversely affected. Further, the aggregation speed in the aggregation in the emulsion aggregation process in the preparation of a toner or the shape changing speed in the coalescence is inhibited from being remarkably decreased, and thus, reduction in the productivity is prevented.

When the molecular weight of the amorphous polyester resin is measured by means of gel permeation chromatography (GPC) of a tetrahydrofuran (THF)-soluble fraction, the weight average molecular weight (Mw) is preferably from 5,000 to 1,000,000, and more preferably from 7,000 to 500,000; the number average molecular weight (Mn) is preferably from 2,000 to 100,000; and the molecular weight distribution Mw/Mn is preferably from 1.5 to 100, and more preferably from 2 to 60.

If the molecular weight and the molecular weight distribution of the amorphous polyester resin are within the above-described ranges, excellent fixing image intensity without interfering with the low-temperature fixing properties may be obtained, which is thus preferable.

In the present exemplary embodiment, the toner mother particles may contain a crystalline polyester resin.

Since the crystalline polyester resin remarkably decreases the toner viscosity when used in combination with an amorphous polyester resin during the melting, and thus, it provides a toner having superior low-temperature fixing properties. Further, among the crystalline polyester resins, the aromatic crystalline polyester resins generally have higher melting temperature ranges than those as described later, and accordingly, in the case where the crystalline polyester resins are included, they are more preferably aliphatic crystalline polyester resins.

In the present exemplary embodiment, the content of the crystalline polyester resin in the toner mother particles is preferably from 2% by weight to 30% by weight, and more preferably from 4% by weight to 25% by weight. If the content of the crystalline polyester resin in the toner mother particles is equal to or more than 2% by weight, the viscosity of the amorphous polyester resin may decrease during the melting, and accordingly, the low-temperature fixing properties are easily improved. Further, when the content of the crystalline polyester resin in the toner mother particles is equal to or less than 30% by weight, deterioration in the charging properties of the toner due to the presence of the crystalline polyester resin is prevented, and a high image intensity after the fixing on a recording medium is easily obtained.

The melting temperature of the crystalline polyester resin is preferably in the range of 50° C. to 90° C., more preferably in the range of 55° C. to 90° C., and still more preferably from 60° C. to 90° C. When the melting temperature is equal to or higher than 50° C., the storability of the toner or the storability of the toner image after the fixing is excellent. Further, when the melting temperature is equal to or lower than 90° C., the low-temperature fixing properties are improved.

Meanwhile, the glass transition temperature (Tg) of the amorphous polyester resin is preferably equal to or higher than 30° C., more preferably from 30° C. to 100° C., and still more preferably from 50° C. to 80° C. When the glass transition temperature (Tg) of the amorphous polyester resin falls within these ranges, the amorphous polyester resin is in a glass state when used, and accordingly, there is no case where the toner particles are aggregated by heat or pressure applied during the image formation, or the particles are adhered and accumulated on the machine. Thus, stable image forming performance over a long period of time is obtained.

The glass transition temperature of the resin may be measured by a known method, for example, a method as defined in ASTM D3418-82 (DSC method).

For measurement of the melting point, of the crystalline resin, a differential scanning calorimeter (DSC) is used, and the melting point may be determined as a melting peak temperature in the input compensation type differential scanning calorimetry as defined in JIS K-7121, when measurement is made at a rate of temperature rise of 10° C. per minute from room temperature to 150° C.

Further, the term "crystalline" as used in the crystalline resin indicates having a clear endothermic peak, not stepwise endothermic changes, in the differential scanning calorimetry (DSC), and specifically, means that the half width value of an endothermic peak at the time when measured at a rate of temperature rise of 10° C./min is 15° C. or lower.

On the other hand, a resin having a half width value of an endothermic peak exceeding 15° C. or a resin having no clear endothermic peak means being non-crystalline (amorphous). The glass transition temperature of the amorphous resin by means of DSC is measured by means of, for example, a differential scanning calorimeter (DSC-50) manufactured by Shimadzu Corporation, equipped with an automatic tangent line processing system, in accordance with ASTM D3418. The measurement conditions are shown below.

Samples: 3 mg to 15 mg, and preferably 5 mg to 10 mg

Measurement method: A sample is put into an aluminum pan, and an empty aluminum pan is used as a reference.

Temperature curve: Temperature rise I (20° C. to 180° C., rate of temperature rise 10° C./min)

From an endothermal curve obtained from the measurement during the temperature rise in the temperature curve, the glass transition temperature is measured.

The glass transition temperature is a temperature at which the differential value of the endothermic curve becomes maximal.

Furthermore, when the crystalline polyester resin includes a polymer formed by copolymerization of other components in the main chain, in the case where the content of other components is less than 50% by weight, this copolymer is also referred to as a crystalline polyester.

Examples of the acid component that is used for the synthesis of the crystalline polyester resin include various polyvalent carboxylic acids, but dicarboxylic acids are preferred, and linear aliphatic dicarboxylic acids are more preferred.

Examples of the acid component include, but are not limited to, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, and lower alkyl esters or acid anhydrides thereof. Among these, taking into consideration easiness of availability, adipic acid, sebacic acid, or 1,10-decanedicarboxylic acid is preferred.

In addition, as the acid component that is used for the synthesis of the crystalline polyester resin, dicarboxylic acids having ethylenically unsaturated bonds or dicarboxylic acids having sulfonic acid groups may be used.

As the alcohol component that is used for the synthesis of the crystalline polyester resin, an aliphatic diol is preferred, and examples thereof include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol. Among these, taking into consideration easiness of availability or cost, 1,4-butanediol, 1,6-hexanediol, 1,8-octanediol, 1,9-nonanediol, and 1,10-decanediol are preferred.

The molecular weight (weight average molecular weight; Mw) of the crystalline polyester resin is preferably from 8,000 to 40,000, and more preferably from 10,000 to 30,000, from the viewpoints of preparation properties of the resin, fine dispersion in the preparation of the toner, and compatibility during melting. When the weight average molecular weight is equal to or more than 8,000, the reduction in the resistance of the crystalline polyester resin is suppressed, and thus, the reduction in the charging properties is also prevented. Meanwhile, when the weight average molecular weight is equal to or less than 40,000, the cost for synthesis of the resin is reduced and the reduction in a sharp melting property is prevented, and accordingly, the low-temperature fixing properties are not adversely affected.

In the present exemplary embodiment, the molecular weight of the polyester resin is measured and calculated by GPC (Gel Permeation Chromatography). Specifically, HLC-8120 manufactured by Tosoh Corporation is used for GPC, TSKGEL SUPERHM-M: (15 cm) manufactured by Tosoh Corporation is used as a column, and the polyester resin is measured with THF as a solvent. Then, the molecular weight of the polyester resin is calculated using a molecular weight calibration curve that has been prepared using monodisperse polystyrene standard samples.

A method for preparation of the polyester resin is not particularly limited, and the polyester resin may be prepared by a general polyester polymerization method for allowing an acid component and an alcohol component to react with each other. The polyester resin is prepared, for example, using a direct polycondensation method or a transesterification method, which is chosen according to the kinds of the monomers. The molar ratio (acid component/alcohol component) in the reaction of the acid component with the alcohol component varies depending on the reaction conditions or the like, and thus, is not simply defined, but it is preferably usually about 1/1 in order to obtain a high molecular weight.

Examples of the catalyst that may be used in the preparation of the polyester resin include compounds of alkali metals such as sodium and lithium; compounds of alkaline earth metals such as magnesium and calcium; compounds of metals such as zinc, manganese, antimony, titanium, tin, zirconium, and germanium; compounds of phosphorous acid; compounds of phosphoric acid; and compounds of amines.

A styrene resin and a (meth)acryl resin, particularly, a styrene(meth)acryl copolymer resin, is useful as a binder resin in the present exemplary embodiment.

A copolymer obtained by polymerizing a monomer mixture composed of 60 parts by weight to 90 parts by weight of vinyl aromatic monomers (styrene monomers), 10 parts by weight to 40 parts by weight of ethylenically unsaturated carboxylic acid ester monomers ((meth)acrylic acid ester monomers), and 1 part by weight to 3 parts by weight of ethylenically unsaturated acid monomers is dispersed and stabilized with a surfactant to give a latex. The latex may be preferably used as a binder resin.

The glass transition temperature of the copolymer is preferably from 50° C. to 70° C.

The polymerizable monomers constituting the above-described copolymer resin are described below.

Examples of the styrene monomer include styrene, α-methylstyrene, vinylnaphthalene, alkyl-substituted styrenes having an alkyl chain, such as 2-methylstyrene, 3-methylstyrene, 4-methylstyrene, 2-ethylstyrene, 3-ethylstyrene, and 4-ethylstyrene, halogen-substituted styrenes such as 2-chlorostyrene, 3-chlorostyrene, and 4-chlorostyrene, and fluorine-substituted styrenes such as 4-fluorostyrene and 2,5-difluorostyrene. Among these, the styrene monomer is preferably styrene.

Examples of the (meth)acrylic acid ester monomer include n-methyl (meth)acrylate, n-ethyl (meth)acrylate, n-propyl (meth)acrylate, n-butyl (meth)acrylate, n-pentyl (meth)acrylate, n-hexyl (meth)acrylate, n-heptyl (meth)acrylate, n-octyl (meth)acrylate, n-decyl (meth)acrylate, n-dodecyl (meth) acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth)acrylate, isoheptyl (meth)acrylate, isooctyl (meth)acrylate, 2-ethylhexyl (meth)acrylate, phenyl (meth)acrylate, biphenyl (meth)acrylate, diphenylethyl (meth)acrylate, t-butylphenyl (meth)acrylate, terphenyl (meth)acrylate, cyclohexyl (meth)acrylate, t-butylcyclohexyl (meth)acrylate, dimethylaminoethyl (meth)acrylate, diethylaminoethyl (meth)acrylate, methoxyethyl (meth)acrylate, 2-hydroxyethyl (meth)acrylate, β-carboxyethyl (meth)acrylate, (meth)acrylonitrile, and (meth) acrylamide. Among these, the (meth)acrylic acid ester monomer is preferably n-butyl acrylate.

The ethylenically unsaturated acid monomer is an ethylenically unsaturated monomer containing an acid group such as a carboxyl group, sulfonic acid group, and acid anhydride.

In the case of incorporating a carboxyl group into the styrene resin, (meth)acryl resin, or styrene-(meth)acryl copolymer resin, this may be attained by copolymerizing carboxyl group-containing polymerizable monomers together.

Specific examples of the carboxyl group-containing polymerizable monomer include acrylic acid, aconitic acid, atropic acid, allylmalonic acid, angelic acid, isocrotonic acid, itaconic acid, 10-undecenoic acid, elaidic acid, erucic acid, oleic acid, o-carboxycinnamic acid, crotonic acid, chloroacrylic acid, chloroisocrotonic acid, chlorocrotonic acid, chlorofumaric acid, chloromaleic acid, cinnamic acid, cyclohexenedicarboxylic acid, citraconic acid, hydroxycinnamic acid, dihydroxycinnamic acid, tiglic acid, nitrocinnamic acid, vinylacetic acid, phenylcinnamic acid, 4-phenyl-3-butenoic acid, ferulic acid, fumaric acid, brassidic acid, 2-(2-furyl) acrylic acid, bromocinnamic acid, bromofumaric acid, bromomaleic acid, benzylidenemalonic acid, benzoylacrylic acid, 4-pentenoic acid, maleic acid, mesaconic acid, methacrylic acid, methylcinnamic acid, and methoxycinnamic acid. Among these, in view of easiness of the polymer-forming reaction, acrylic acid, methacrylic acid, maleic acid, cinnamic acid, and fumaric acid are preferred, and acrylic acid is more preferred.

The binder resin may use a chain transfer agent at the polymerization thereof.

The chain transfer agent is not particularly limited, but examples thereof include a compound having a thiol component. Specific preferred examples thereof include alkyl mercaptans such as hexyl mercaptan, heptyl mercaptan, octyl mercaptan, nonyl mercaptan, decyl mercaptan, and dodecyl mercaptan. These are preferred in that the molecular weight distribution becomes narrow, and thus, good storability of the toner at a high temperature is obtained.

A crosslinking agent may be added to the binder resin, if desired. The crosslinking agent is typically a polyfunctional monomer having two or more ethylenically unsaturated groups in the molecule.

Specific examples of the crosslinking agent include aromatic polyvinyl compounds such as divinyl benzene and divinyl naphthalene; polyvinyl esters of aromatic polyvalent carboxylic acids such as divinyl phthalate, divinyl isophthalate, divinyl terephthalate, divinyl homophthalate, divinyl/trivinyl trimesate, divinyl naphthalene dicarboxylate, and divinyl biphenyl carboxylate, divinyl esters of nitrogen-containing aromatic compounds, such as divinyl pyridine dicarboxylate, vinyl esters of unsaturated heterocyclic carboxylic acids, such as vinyl pyromucate, vinyl furan carboxylate, vinyl pyrrole-2-carboxylate, and vinyl thiophene carboxylate, (meth) acrylate esters of linear polyvalent alcohols, such as butanediol methacrylate, hexanediol acrylate, octanediol methacrylate, decanediol acrylate, and dodecanediol methacrylate, branched, substituted polyvalent alcohol (meth) acrylates such as neopentyl glycol dimethacrylate, 2-hydroxy-1,3-diacryloxypropane, and polyvalent polyvinyl carboxylate esters such as polyethylene glycol di(meth)acrylate, polypropylene polyethylene glycol di(meth)acrylates, divinyl succinate, divinyl fumarate, vinyl/divinyl maleate, divinyl diglycolate, vinyl/divinyl itaconate, divinyl acetone dicarboxylate, divinyl glutarate, divinyl 3,3'-thiodipropionate, divinyl/trivinyl trans-aconate, divinyl adipate, divinyl pimelate, divinyl suberate, divinyl azelate, divinyl sebacate, dodecane diacid divinyl, and divinyl brassylate.

In the present exemplary embodiment, these crosslinking agents may be used singly or in combination of two or more kinds thereof.

A content of the crosslinking agent is preferably in the range of 0.05% by weight to 5% by weight, and more preferably in the range of 0.1% by weight to 1.0% by weight, with respect to the total amount of the polymerizable monomer.

Among the above-described binder resins, one prepared by radical polymerization of polymerizable monomers may be polymerized using a radical polymerization initiator.

The radical polymerization initiator is not particularly limited. Specific examples of the radical polymerization initiator include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethyl benzoyl peroxide, lauroyl peroxide, ammonium persulfate, sodium persulfate, potassium persulfate, peroxy carbonate diisopropyl, tetralin hydroperoxide, 1-phenyl-2-methylpropyl-1-hydroperoxide, pertriphenyl acetate-tert-butyl hydroperoxide, tert-butyl performate, tert-butyl peracetate, tert-butyl perbenzoate, tert-butyl perphenylacetate, tert-butyl permethoxyacetate, and tert-butyl perN-(3-toluoyl)carbamate, azo compounds such as 2,2'-azobispropane, 2,2'-dichloro-2,2'-azobispropane, 1,1'-azo (methylethyl)diacetate, 2,2'-azobis(2-amidinopropane) hydrochloride, 2,2'-azobis(2-amidinopropane)nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenyl azodiphenyl methane, phenyl azotriphenyl methane, 4-nitrophenyl azotriphenylmethane, 1,1'-azobis-1,2-diphenylethane, poly(bisphenol A-4,4'-azobis-4-cyanopentanoate), and poly(tetraethylene glycol-2,2'-azobisisobutyrate), 1,4-bis(pentaethylene)-2-tetrazene, and 1,4-dimethoxycarbonyl-1,4-diphenyl-2-tetrazene.

Furthermore, examples of the crystalline vinyl resins include vinyl resins using long chain alkyl or alkenyl (meth) acrylate esters, such as amyl (meth)acrylate, hexyl (meth) acrylate, heptyl (meth)acrylate, octyl (meth)acrylate, nonyl (meth)acrylate, decyl (meth)acrylate, undecyl (meth)acrylate, tridecyl (meth)acrylate, myristyl (meth)acrylate, cetyl (meth)acrylate, stearyl (meth)acrylate, oleyl (meth)acrylate, and behenyl (meth)acrylate. Incidentally, in the present specification, the description of "(meth)acrylate" means including at least any one of "acryl" and "(meth)acryl".

Furthermore, the weight average molecular weight of an addition polymerization resin such as a styrene resin and a (meth)acryl resin is preferably from 5,000 to 50,000, and more preferably from 7,000 to 35,000. If the weight average molecular weight is equal to or more than 5,000, the aggregation power as a binder resin is good and there is no occurrence of hot-offset properties. Further, if the weight average molecular weight is equal to less than 50,000, good hot-offset properties and good lowest fixing temperature may be obtained, and further, the time or temperature required for polycondensation is suitable and preparation efficiency is good.

Furthermore, the weight average molecular weight of the binder resin may be measured by, for example, gel permeation chromatography (GPC).

The content of the binder resin in the toner of the present exemplary embodiment is not particularly limited, but is preferably from 10% by weight to 95% by weight, more preferably from 25% by weight to 90% by weight, and still more preferably from 45% by weight to 85% by weight, based on the total weight of the toner. Within these ranges, for example, the fixing properties and the charging characteristics are good.

Colorant

The toner mother particles contain a colorant.

Examples of the colorant used in the toner of the present exemplary embodiment include magnetic powder such as magnetite and ferrite; various pigments such as carbon black, lamp black, Chrome Yellow CHROME YELLOW, HANSA YELLOW, BENZIDINE YELLOW, INDANTHRENE YELLOW, QUINOLINE YELLOW, PERMANENT ORANGE GTR, PYRAZOLONE ORANGE, VULKAN ORANGE, WATCHYOUNG RED, Permanent Red PERMANENT RED, BRILLIANT CARMINE 3B, BRILLIANT CARMINE 6B, DUPONT OIL RED, PYRAZOLONE RED, LITHOL RED, RHODAMINE B LAKE, LAKE RED C, ROSE BENGAL, ANILINE BLUE, ULTRAMARINE BLUE, CALCO OIL BLUE, Methylene Blue Chloride, PHTHALOCYANINE BLUE, Phthalocyanine Green, and MALACHITE GREEN OXALATE; and dyes such as an acridine-based dye, a xanthene-based dye, an azo-based dye, a benzoquinone-based dye, an azine-based dye, an anthraquinone-based dye, a thioindigo-based dye, a dioxadine-based dye, a thiazine-based dye, an azomethine-based dye, an indigo-based dye, a thioindigo-based dye, a phthalocyanine-based dye, an aniline black-based dye, a polymethine-based dye, a triphenylmethane-based dye, a diphenylmethane-based dye, a thiazine-based dye, a thiazole-based dye, and a xanthene-based dye. These various dyes may be used singly or in combination of two or more kinds thereof.

Examples of the colorant also include C. I. Pigment Red 48:1, C. I. Pigment Red 122, C. I. Pigment Red 57:1, C. I. Pigment Yellow 97, C.I. Pigment Yellow 17, C. I. Pigment Blue 15:1, and C. I. Pigment Blue 15:3.

The content of the colorant in the toner mother particles is preferably from 1 part by weight to 30 parts by weight with respect to 100 parts by weight of the binder resin of the toner mother particles. A colorant that has been surface-treated or a pigment dispersant may also be used, if desired. A toner having any of various colors, such as a yellow toner, a magenta toner, a cyan toner, a black toner, and the like, may be obtained by appropriately selecting the kind of the colorants.

Release Agent

The toner mother particles contain a release agent.

The release agent that is used in the present exemplary embodiment is not particularly limited, but known materials are used, and waxes as follows are preferred.

Examples thereof include a paraffin wax and a derivative thereof, a montan wax and a derivative thereof, a microcrystalline wax and a derivative thereof, a Fischer-Tropsch wax and a derivative thereof, and a polyolefin wax and a derivative thereof. The derivatives include an oxide, a polymer with a vinyl monomer, and a graft modified product. In addition, for example, alcohols, fatty acids, plant waxes, animal waxes, mineral waxes, ester waxes, or acid amides may also be used.

As the wax used as the release agent, a wax that melts at any temperature of 70° C. to 140° C. and has a melt viscosity of 1 centipoise to 200 centipoises is preferred, and a wax that has a melt viscosity of 1 centipoise to 100 centipoises is more preferred. When the temperature at which the wax melts is equal to or higher than 70° C., the temperature at which the wax varies is sufficiently high, and the blocking resistance and the developability when the temperature within a copying machine increases are excellent. When the temperature at which the wax melts is equal to lower than 140° C., the temperature at which the wax varies is sufficiently low, it is not necessary to perform fixing at high temperatures, and the energy saving is excellent. Also, when the melt viscosity of the wax is equal to or less than 200 centipoises, elution of the wax from the toner is appropriate, and the fixing releasability is excellent.

In the toner of the present exemplary embodiment, the release agent is selected from the viewpoints of fixing properties, toner blocking properties, or toner strength. The addition amount of the release agent is not particularly limited, but is preferably in the range of 2 parts by weight to 20 parts by weight with respect to 100 parts by weight of the binder resin contained in the toner mother particles.

Other Additives

In addition to the components as described above, various components such as an internal additive, a charge-controlling agent may be added to the colored particles, as desired.

Examples of the internal additive include magnetic materials of metals or alloys such as ferrite, magnetite, reduced iron, cobalt, nickel, and manganese; and compounds containing such metals.

Examples of the charge-controlling agent include quaternary ammonium salt compounds, nigrosine compounds, dyes including a complex of aluminum, iron, chromium, or the like, and triphenylmethane pigments.

The preparation method for the toner mother particles that are used in the present exemplary embodiment is not particularly limited, and a known method may be used. Specific examples thereof include the methods as follows.

For the preparation of the toner mother particles, a kneading pulverizing method in which a binder resin, a colorant, a release agent, and optionally, a charge-controlling agent, and the like are kneaded, ground, and classified; a method of changing the shape of the particles obtained by the kneading and pulverizing method, using a mechanical impact force or a thermal energy; an emulsion aggregation method in which a dispersion obtained by emulsifying and dispersing a binder resin is mixed with a dispersion containing a colorant, a release agent, and optionally a charge-controlling agent and the like, aggregated, heated, and fused to obtain toner particles; an emulsion polymerization aggregation method in which a dispersion obtained by emulsion-polymerizing polymerizable monomers of a binder resin is mixed with a dispersion containing a colorant, a release agent, and optionally a charge-controlling agent and the like, aggregated, heated, and coalesced to obtain toner particles; a suspension polymerization method in which polymerizable monomers for obtaining a binder resin and a solution containing a colorant, a release agent, and optionally a charge-controlling agent and the like, are suspended in an aqueous solvent and polymerized therein; and a dissolution suspension method in which a binder resin and a solution containing a colorant, a release agent, and optionally, a charge-controlling agent and the like, are suspended in an aqueous solvent to form particles, may be used. Moreover, a method for preparing a toner having a core-shell structure in which aggregated particles are further attached to the toner mother particles obtained by the above-described method, as a core, and then heated and coalesced may be used.

Among these, the toner of the present exemplary embodiment is preferably a toner obtained by an emulsion aggregation or an emulsion polymerization aggregation method (emulsion-aggregated toner).

The particle diameter of the toner mother particles thus prepared in terms of a volume average particle diameter is preferably in the range of 2 μm to 8 μm, and more preferably in the range of 3 μm to 7 μm. If the volume average particle diameter is equal to or more than 2 μm, the fluidity of the toner is good and sufficient charging properties are imparted from the carrier, and as a result, it is not easy to cause generation of fogging in the background portion or deterioration in density reproducibility. Further, if the volume average particle diameter is equal to or less than 8 μm, the effect of improving the reproducibility of fine dots, gradation and particle forming properties is good, thereby obtaining an image with high image quality. In addition, the volume average particle diameter is measured with a measurement device such as a COULTER MULTISIZER II (manufactured by Beckman Coulter, Inc.).

It is preferable that the toner mother particles have a pseudo-spherical shape from the viewpoints of enhancement of the developing property, the transferring efficiency, and the image quality. The sphericity of the toner mother particles may be expressed by the shape factor SF1 represented as shown by the following formula, and the average value of the shape factor SF1 (average shape factor) of the toner mother particles used in the present exemplary embodiment is preferably less than 145, more preferably from 115 to 140, and still more preferably from 120 to 140. When the average value of the shape factor SF1 is less than 145, good transferring efficiency may be obtained, thus providing excellent image quality.

$$|SF1 = \frac{(ML)^2}{A} \times \frac{\pi}{4} \times 100$$

In this formula, ML represents the maximum length of the respective toner mother particles, and A represents the projected area of the toner mother particles.

Incidentally, the average value of the shape factor SF1 (average shape factor) is measured in such a manner that an optical micrograph of 1,000 toner images magnified 250 times is analyzed with an image analyzer (LUZEX III, manufactured by Nireco Corporation), the values of the shape factor SF1 of each particle are obtained from the maximum length and the projected area, and the obtained values are averaged.

Electrostatic Charge Image Developer

The toner for developing an electrostatic charge image of the present exemplary embodiment is suitably used as an electrostatic charge image developer.

The electrostatic charge image developer of the present exemplary embodiment is not particularly limited, except for a case where it contains the toner for developing an electrostatic charge image of the present exemplary embodiment, and it may take a proper component composition depending upon the purpose. When the toner for developing an electrostatic charge image of the present exemplary embodiment is used singly, an electrostatic charge image developer of a single-component system is prepared, and when the electrostatic charge image developing toner of the present exemplary embodiment is used in combination with a carrier, an electrostatic charge image developer of a two-component system is prepared.

As for the single-component developer, a method in which frictional electrification with a developing sleeve or charge member is performed to form a charged toner, followed by developing depending upon an electrostatic latent image is also applied.

In the present exemplary embodiment, the development system is not specified, but a two-component development system is preferred. Further, so far as the conditions are satisfied, the carrier is not particularly specified. However, examples of a core material of the carrier include magnetic metals such as iron, steel, nickel, and cobalt; alloys thereof with manganese, chromium, a rare earth metal or the like; and magnetic oxides such as ferrite and magnetite. From the viewpoints of core material surface properties and core material resistance, an alloy thereof with, for example, ferrite, particularly manganese, lithium, strontium, or magnesium is preferred.

The carrier used in the present exemplary embodiment is preferably one obtained by coating a resin on the core material surface. The resin is not particularly limited and is properly chosen depending upon the purpose. Examples thereof include known resins, such as polyolefin resins such as polyethylene and polypropylene; polyvinyl resins and polyvinylidene resins such as polystyrene, acrylic resins, polyacrylonitrile, polyvinyl acetate, polyvinyl alcohol, polyvinyl butyral, polyvinyl chloride, polyvinylcarbazole, polyvinyl ether, and polyvinyl ketone; a vinyl chloride-vinyl acetate copolymer; a styrene-acrylic acid copolymer; a straight-chain silicone resin composed of an organosiloxane bond or modified products thereof; fluorine-based resins such as polytetrafluoroethylene, polyvinyl fluoride, polyvinylidene fluoride, and polychlorotrifluoroethylene; silicone resins; polyesters; polyurethanes; polycarbonates; phenol resins; amino resins such as a urea-formaldehyde resin, a melamine resin, a benzoguanamine resin, a urea resin, and a polyamide resin; and epoxy resins. These resins may be used singly or in combinations of two or more kinds thereof. In the present exemplary embodiment, among these resins, it is preferable to use at least a fluorine-based resin and/or a silicone resin. The use of at least a fluorine-based resin and/or a silicone resin as the resin is beneficial in view of the fact that the effect of preventing carrier contamination (impaction) due to the toner or external additive is high.

As for the coating film made of the resin, it is preferable that a resin particle and/or a conductive particle be dispersed in the resin. Examples of the resin particles include a thermoplastic resin particle and a thermosetting resin particle. Among these, a thermosetting resin is preferable from the viewpoint that it is relatively easy to increase the hardness, and a resin particle composed of a nitrogen-containing resin containing N atoms is preferable from the viewpoint of imparting negative chargeability to the toner. These resin particles may be used singly or in combinations of two or more kinds thereof. An average particle diameter of the resin particles is preferably from 0.1 μm to 2 μm, and more preferably from 0.2 μm to 1 μm. When the average particle diameter of the resin particles is equal to or more than 0.1 μm, the dispersibility of the resin particles in the coating film is excellent, whereas when the average particle diameter of the resin particles is equal to or less than 2 μm, dropping of the resin particles from the coating film hardly occurs.

Examples of the conductive particle include metal particles of gold, silver, copper and the like; carbon black particles; and particles obtained by coating the surface of a powder of titanium oxide, zinc oxide, barium sulfate, aluminum borate, potassium titanate, or the like with tin oxide, carbon black, a metal or the like. These materials may be used singly or in combinations of two or more kinds thereof. Among these, carbon black particles are preferable in view of the fact that manufacturing stability, costs, conductivity, and the like are favorable. The kind of carbon black is not particularly limited, but carbon black having a DBP oil absorption amount of from 50 ml/100 g to 250 ml/100 g is preferred because of its excellent manufacturing stability. The coating amount of each of the resin, the resin particle and the conductive particle on the core material surface is preferably from 0.5% by weight to 5.0% by weight, and more preferably from 0.7% by weight to 3.0% by weight.

A method for forming the coating film is not particularly limited, but examples thereof include a method using a coating film forming solution in which the resin particles such as crosslinking resin particles and/or conductive particles, and the resin such as a styrene-acrylic resin, a fluorine-based resin and a silicone resin as a matrix resin are contained in a solvent.

Specific examples thereof include a dipping method of dipping the carrier core material in the coating film forming solution; a spray method of spraying the coating film forming solution onto the surface of the carrier core material; and a kneader coater method of mixing the coating film forming solution and the carrier core material in a state where it is floated by flowing air and removing the solvent. Among these, the kneader coater method is preferred in the present exemplary embodiment.

The solvent used in the coating film forming solution is not particularly limited as long as it is capable of dissolving only the resin that is a matrix resin. The solvent is chosen from known solvents, and examples thereof include aromatic hydrocarbons such as toluene and xylene, ketones such as acetone and methyl ethyl ketone, and ethers such as tetrahydrofuran and dioxane. In the case where the resin particles are dispersed in the coating film, since the resin particles and the particles as a matrix resin are uniformly dispersed in the thickness direction thereof and in the tangential direction to the carrier surface, even when the carrier is used for a long period of time, and the coating film is abraded, the surface formation which is similar to that of an unused state may be permanently maintained, and a favorable ability for applying electrification to the toner may be maintained over a long period of time. Also, in the case where the conductive particles are dispersed in the coating film, since the conductive particles and the resin as a matrix resin are uniformly dispersed in the thickness direction thereof and in a tangential direction to the carrier surface, even when the carrier is used for a long period of time, and the coating film is abraded, the surface formation which is similar to that of an unused state may be permanently maintained, and deterioration of the carrier may be prevented over a long period of time. In the case where the resin particles and the conductive particles are dispersed in the coating film, the above-described effects are exhibited at the same time.

The electric resistivity of the whole of the thus formed magnetic carrier in a magnetic brush state in an electric field of $10^4$ V/cm is preferably from $10^8$ Ωcm to $10^{13}$ Ωcm. When the electric resistivity of the magnetic carrier is equal to or more than $10^8$ Ωcm, adhesion of the carrier to an image area on the image holding member is suppressed, and a brush mark is hardly generated. On the other hand, where the electric resistivity of the magnetic carrier is equal to or less than $10^{13}$ Ωcm, the generation of an edge effect is suppressed, and a favorable image quality is obtainable.

The electric resistivity (intrinsic volume resistivity) is measured as follows.

A sample is placed on a lower grid of a measuring jig that is a pair of 20 $cm^2$ circular grids (made of steel) connected to an electrometer (trade name: KEITHLEY 610C, manufactured by Keithley Instruments Inc.) and a high-voltage power supply (trade name: FLUKE 415B, manufactured by Fluke Corporation), so as to form a flat layer having a thickness of from about 1 mm to 3 mm. Subsequently, after the sample is placed on the upper grid, in order to make a sample-to-sample space free, a weight of 4 kg is placed on the upper grid. A thickness of the sample layer is measured in this state. Subsequently, by impressing a voltage to both grids, a current value is measured, and an intrinsic volume resistivity is calculated according to the following formula:

$$\text{Intrinsic volume resistivity} = \text{Applied voltage} \times 20 \div (\text{Current value} - \text{Initial current value}) \div \text{Sample Thickness}$$

wherein the initial current value is a current value when the applied voltage is 0, and the current value is a measured current value.

As for a mixing proportion of the toner in the present exemplary embodiment to the carrier in the electrostatic charge image developer of a two-component system, the amount of the toner is preferably from 2 parts by weight to 10 parts by weight based on 100 parts by weight of the carrier. Further, a method for preparing the developer is not particularly limited, but examples thereof include a method of mixing by a V BLENDER or the like.

Image Forming Method

Moreover, the electrostatic charge image developer (toner for developing an electrostatic charge image) is used for an image forming method of an electrostatic charge image development system (electrophotographic system).

The image forming method of the present exemplary embodiment includes charging a surface of an image holding member; forming an electrostatic latent image on the surface of the image holding member; developing the electrostatic latent image formed on the surface of the image holding member by a developer containing a toner to form a toner image; and transferring the toner image onto the surface of a transfer medium, and may further include fixing the toner image transferred onto the surface of the transfer medium; and cleaning the electrostatic charge image developer remaining on the image holding member, and as the developer, the toner for developing an electrostatic charge image of the present exemplary embodiment or the electrostatic charge image developer of the present exemplary embodiment is preferably used.

The respective steps above are general steps themselves, and are disclosed in, for example, JP-A-56-40868 and JP-A-49-91231. Further, the image forming method of the present exemplary embodiment may be implemented using a known image forming apparatus, such as a copying machine and a facsimile machine.

The formation of an electrostatic latent image is to form an electrostatic latent image on an image holding member (photoreceptor).

The development is to develop the electrostatic latent image by a developer layer on a developer holding member to form a toner image. The developer layer is not particularly limited as long as it contains the toner for developing an electrostatic charge image of the present exemplary embodiment.

The transfer is to transfer the toner image onto a transfer medium. Further, examples of the transfer medium in the transfer step include recording media such as an intermediate transfer medium and paper.

In the fixing above, for example, a system in which a toner image transferred onto a transfer paper by a heating roller fixing machine with a temperature of a heating roller set at a constant temperature is fixed to form a copied image, may be mentioned.

The cleaning is to clean the electrostatic charge image developer remaining on the image holding member.

Furthermore, in the image forming method of the present exemplary embodiment, the cleaning more preferably includes removing the electrostatic charge image developer remaining on the image holding member by a cleaning blade.

As the recording medium, known ones may be used, and examples thereof include paper and OHP sheets used in a copying machine, printer or the like in an electrophotographic system. For example, coat paper obtained by coating the surface of plain paper with a resin or the like, and printing art paper may be suitably used.

In the image forming method of the present exemplary embodiment, recycling may also be included. The recycling is to transfer the toner for developing an electrostatic charge image that has been collected in the cleaning to a developer layer. The image forming method of the exemplary embodiment including the recycling is carried out by using an image forming apparatus such as a copying machine and a facsimile machine, having a toner recycling system type. Further, it may also be applied to a recycling system in an embodiment in which a toner is collected at the same time with developing.

Image Forming Apparatus

The image forming apparatus of the present exemplary embodiment includes an image holding member, a charging unit that charges a surface of the image holding member, a latent image forming unit that forms an electrostatic latent image on the surface of the image holding member, a development unit that develops the electrostatic latent image by a developer including a toner to form a toner image, and a transfer unit that transfers the toner image from the image holding member to the surface of a transfer medium, and may further include a fixing unit that fixes the transferred toner image onto the surface of a transfer medium, and a cleaning unit that cleans the image holding member, and as the developer, the toner for developing an electrostatic charge image of the present exemplary embodiment or the electrostatic charge image developer of the present exemplary embodiment is preferably used.

Furthermore, the image forming apparatus of the present exemplary embodiment is not particularly limited, as long as it includes at least the image holding member, the charging unit, the exposure unit, the developing unit, and the transfer unit, as described above. Further, for example, a fixing unit, a cleaning unit, or an erasing unit may be included therein, if desired.

In the transfer unit, the transfer may be carried out two or more times using an intermediate transfer medium. Further, examples of the transfer medium in the transfer unit include recording media such as an intermediate transfer medium and paper.

In the image holding member and the respective units, the constitution described in each step in the image forming method may be preferably used. As each of the units, any of units known in the image forming apparatus are utilized. Further, the image forming apparatus used in the present exemplary embodiment may include units, apparatuses, and the like other than the above-described constitution. In addition, in the image forming apparatus of the present exemplary embodiment, two or more of the above-described units above may be used at the same time.

Furthermore, examples of the unit that cleans the electrostatic charge image developer remaining in the image holding member include a cleaning blade and a cleaning brush, and the cleaning blade is preferred.

Preferred examples of the material for the cleaning blade include urethane rubber, neoprene rubber, and silicone rubber.

Toner Cartridge, Developer Cartridge, and Process Cartridge

The toner cartridge of the present exemplary embodiment is a toner cartridge accommodating at least the toner for developing an electrostatic charge image of the present exemplary embodiment therein.

The developer cartridge of the present exemplary embodiment is a developer cartridge accommodating at least the electrostatic charge image developer of the present exemplary embodiment therein.

Furthermore, the process cartridge of the present exemplary embodiment is a process cartridge which accommodates the electrostatic charge image developer of the present exemplary embodiment therein, and includes a developer holding member that holds and transports the electrostatic charge image developer. Further, the process cartridge is preferably a process cartridge which includes at least one selected from the group consisting of a developing unit that develops the electrostatic latent image formed on the surface of the image holding member by the toner for developing an electrostatic charge image or the electrostatic charge image developer to form a toner image, an image holding member, a charging unit that charges the surface of the image holding member, and a cleaning unit that removes the toner remaining on the surface of the image holding member, and which accommodates at least the toner for developing an electrostatic charge image of the present exemplary embodiment, or the electrostatic charge image developer of the present exemplary embodiment therein.

The toner cartridge of the present exemplary embodiment is preferably detachable from an image forming apparatus. That is, the toner cartridge of the present exemplary embodiment accommodating the toner of the present exemplary embodiment therein is preferably used in the image forming apparatus which is configured to have the toner cartridge detachable therefrom.

The developer cartridge of the present exemplary embodiment is not particularly limited as long as it contains an electrostatic charge image developer including the toner for developing an electrostatic charge image of the present exemplary embodiment. For example, the developer cartridge which is detachable from an image forming apparatus including a developing unit accommodates an electrostatic charge image developer including the toner for developing an electrostatic charge image of the present exemplary embodiment which is then supplied to the developing unit.

Furthermore, the developer cartridge may be a cartridge accommodating a toner and a carrier therein, or may have a constitution that a cartridge accommodating a toner alone therein and a cartridge accommodating a carrier alone therein are separate cartridges.

The process cartridge of the present exemplary embodiment is preferably detachable from an image forming apparatus.

In addition, the process cartridge of the present exemplary embodiment may contain other members such as an erasing unit, if desired.

The toner cartridge and the process cartridge may employ known constitutions which are referred to, for example, in JP-A-2008-209489 and JP-A-2008-233736.

EXAMPLES

Hereinbelow, the present exemplary embodiment will be described in detail with reference to Examples, but is not construed to be limited thereto. Further, in the following description, "part(s)" mean(s) "part(s) by weight" unless otherwise specified.

Toner Particles

Toner Mother Particles 1 [Aggregated and Coalesced Toner Particles]

Preparation of Polyester Resin Dispersion

Ethylene glycol (manufactured by Wako Pure Chemical Industries, Ltd.): 37 parts

Neopentyl glycol (manufactured by Wako Pure Chemical Industries, Ltd.): 65 parts 1,9-Nonanediol (manufactured by Wako Pure Chemical Industries, Ltd.): 32 parts Terephthalic acid (manufactured by Wako Pure Chemical Industries, Ltd.): 96 parts The above monomers are put into a flask and the temperature is raised to 200° C. for 1 hour. After confirming that the reaction system is uniformly stirred, 1.2 parts of dibutyltin oxide is added thereinto. Further, the temperature is further raised to 240° C. for 6 hours while a dehydration-condensation reaction is allowed to continue at 240° C. for an additional 4 hours with evaporation of the resulting water. A polyester resin A having an acid value of 9.4 mg KOH/g, a weight average molecular weight of 13,000, and a glass transition temperature of 62° C. is thus obtained.

Then, the obtained polyester resin A in a molten state is transferred to a disperser CAVITRON CD 1010 (manufactured by Eurotec Ltd.) at a rate of 100 parts per minute. Diluted aqueous ammonia having a concentration of 0.37% by weight is prepared by diluting aqueous ammonia as a reagent with deionized water, and put into an aqueous medium tank that is separately prepared. The diluted aqueous ammonia is transferred to the CAVITRON at a rate of 0.1 L per minute while heating it to 120° C. by a heat exchanger, together with the molten polyester resin. The CAVITRON is operated by rotating the rotor under the conditions of a rotation speed of 60 Hz and a pressure of 5 kg/cm$^2$. An amorphous polyester resin dispersion, in which resin particles having a volume average particle diameter of 160 nm, a solid content of 30%, a glass transition temperature of 62° C., and a weight average molecular weight Mw of 13,000 are dispersed, is thus obtained.

Preparation of Colorant Dispersion

Cyan pigment (C. I. Pigment Blue 15:3, copper phthalocyanine, manufactured by Dainichiseika Color & Chemicals Mfg. Co., Ltd.): 10 parts Anionic surfactant (NEOGEN SC, manufactured by Daiichi Kogyo Seiyaku Co., Ltd.): 2 parts Deionized water: 80 parts The above components are mixed and dispersed with a high pressure impact type disperser ALTIMIZER (HJP30006, manufactured by Sugino Machine Limited) for 1 hour to obtain a colorant dispersion having a volume average particle diameter of 180 nm and a solid content of 20%.

Preparation of Release Agent Dispersion

Carnauba wax (RC-160, melt temperature 84° C., manufactured by Toagosei Co., Ltd.): 50 parts Anionic surfactant (NEOGEN SC, manufactured by Daiichi Kogyo Seiyaku Co., Ltd.): 2 parts Deionized water: 200 parts The above components are heated to 120° C., and mixed and dispersed with ULTRA TURRAX T50 manufactured by IKA. Then, the mixture is subjected to a dispersion treatment with a pressure ejection type GAULIN homogenizer to obtain a release agent dispersion having a volume average particle diameter of 200 nm and a solid content of 20%.

Preparation of Toner Particles

Polyester resin dispersion: 200 parts

Colorant dispersion: 25 parts

Release agent particle dispersion: 30 parts

Polyaluminum chloride: 0.4 parts

Deionized water: 100 parts

The above components are put into a stainless steel flask, and mixed and dispersed using ULTRA TURRAX manufactured by IKA. Then, the flask is heated to 48° C. while stirring in a heating oil bath. The flask is held at 48° C. for 30 minutes, and 70 parts of the polyester resin dispersion as described above is then added thereto.

Thereafter, the pH in the system is adjusted to 8.0 with an aqueous sodium hydroxide solution at a concentration of 0.5 mol/L, and the stainless steel flask is sealed. The flask is heated to 90° C. while continuing stirring the seal of the stirring axis with a magnetic force seal and held for 3 hours. After completion of the reaction, the flask is cooled at a cooling rate of 2° C./rain, and the mixture is filtered and washed with deionized water, followed by solid-liquid separation with Nutsche suction filtration. The solid is re-dispersed in 3,000 parts of deionized water at 30° C., followed by stirring and washing at 300 rpm for 15 minutes. This washing operation is repeated six times, and when the filtrate has a pH of 7.54, and an electric conductivity of 6.5 μS/cm, solid-liquid separation is conducted using No. 5A filter paper by Nutsche suction filtration. Then, vacuum drying is continued for 12 hours to obtain toner particles 1.

The volume average particle diameter $D_{50v}$ of the toner particles 1 is measured with a Coulter counter and found to be 5.8 μm, and the SF1 is 130.

Toner Mother Particles 2 [Kneading Pulverizing Method]

Preparation of Toner Particles 2

Polyester resin: 85 parts

Cyan pigment (C. I. Pigment Blue 15:3, copper phthalocyanine, manufactured by Dainichiseika Color Chemicals Mfg. Co., Ltd.): 7 parts Carnauba wax RC-160 (melt temperature 84° C.: manufactured by Toagosei Co., Ltd.): 8 parts The above components are pre-mixed using a Henschel mixer, and then kneaded using a biaxial kneader. The kneaded mixture is rolling-cooled with a water-cooling type cooling conveyer, coarsely ground with a pin crusher, and further ground with a hammer mill to a particle diameter of about 300 μm. The coarsely ground product is pulverized with a fluidized-bed type mill AFG400 (manufactured by Alpine GmbH), and classified with a classifier EJ30 to obtain toner particles 2 having an average volume particle diameter ($D_{50v}$) of 6.1 μm.

Preparation of External Additive

External Treatment Additive 1

100 parts of AEROSIL OX50 (fumed silica, manufactured by Nippon Aerosil Co., Ltd.) as the inorganic particles is put into an eggplant-type flask together with 200 parts of methanol and 10 parts of HMDS (hexamethyldisilazane, manufactured by Wako Pure Chemical Industries, Ltd.) in advance, and set in a rotary evaporator. After stirring at room temperature (25° C.) for 30 minutes, the mixture is heated at a temperature of 80° C. and deaerated under reduced pressure, and methanol is removed. Further, vacuum drying is carried out at 120° C. for 2 hours in each of the eggplant-type flasks. After drying, the treated product is collected and crushed to obtain an external treatment additive A.

100 parts of the external treatment additive A, 200 parts of NOVEC 7100 (manufactured by 3M Corp.), and 20 parts of DEMNUM S-65 (perfluoropolyether, manufactured by Daikin Industries, Ltd.) are put into an eggplant-type flask, and set in a rotary evaporator. After stirring at room temperature (25° C.) for 30 minutes, the mixture is heated at a temperature of 80° C. and deaerated under reduced pressure as above, and Novec 7100 is removed. Further, in the same manner as above, vacuum drying is carried out at 150° C. for 2 hours using a vacuum drier. After drying, the treated product is collected and crushed to obtain an external treatment additive 1.

External Treatment Additives 2 to 13

In the same manner as for the external treatment additive 1, external treatment additives 2 to 13 are each prepared with the composition described in Table 1. Here, inorganic particles MT-150A (titania, manufactured by Tayca Corporation), KBM-22 (dimethyldimethoxysilane, manufactured by Shin-Etsu Chemical Co., Ltd.) as a hydrophobizer, KRYTOX GPL101 (hexafluoropropylene epoxide, manufactured by DuPont) as the fluorine atom-containing oil, and DAIFLOYL #3 (low-polymerization product of chlorotrifluoroethylene, manufactured by Daikin Industries, Ltd.) are used. Further, KF-96 (dimethylsilicone oil, manufactured by Shin-Etsu Chemical Co., Ltd.) is used as the silicone oil. The solvent used in the treatment of the silicone oil is changed from NOVEC 7100 to toluene.

Preparation of Toners

Using a HENSCHEL mixer, 1.5 parts of the external additive described in Table 2 is added, with respect to 100 parts of the toner particles 1 or 2, thereby preparing each of the toners.

Preparation of Electrostatic Charge Image Developer

Preparation of Carrier

Ferrite particles (average particle diameter: 50 μm): 100 parts

Toluene: 14 parts

Styrene-methacrylate copolymer (component ratio: 90/10): 2 parts

Carbon black (R330: manufactured by Cabot Corporation): 0.2 parts

First, the above components, exclusive of ferrite particles, are stirred and dispersed for 10 minutes with a stirrer to prepare a dispersed coating liquid. Then, the coating liquid and the ferrite particles are put into a vacuum deaeration kneader, and stirred at 60° C. for 30 minutes, the pressure is then reduced while warming the mixture for deaeration, and the mixture is dried to prepare a carrier.

4 parts of the toner and 96 parts of the carrier are stirred at 40 rpm for 20 minutes using a V BLENDER, and sieved with a mesh with a pore size of 250 μm to prepare each of electrostatic charge image developers.

Method for Measuring Volume Average Particle Diameter of Toner Mother Particles

The volume average particle diameter of the toner mother particles is measured using a COULTER MULTISIZER 11 (manufactured by Beckman Coulter, Inc.). As the electrolytic solution, ISOTON-II (manufactured by Beckman Coulter, Inc.) is used.

For this measurement method, 0.5 mg to 50 mg of a measurement sample is put into 2 mL of an aqueous surfactant solution, which is preferably a 5% aqueous solution of sodium alkylbenzenesulfonate, as a disperser, and is then added to 100 mL to 150 mL of the electrolytic solution. The electrolytic solution having the measurement sample dispersed therein is subjected to a dispersion treatment for about 1 minute with an ultrasonic dispersing device, and the particle size distribution of the particles having a particle diameter in the range of 2.0 μm to 60 μm is measured with the COULTER MULTISIZER II using an aperture having an aperture size of 100 μm. The number of particles to be measured is 50,000.

The particle size distribution thus measured is divided into particle size ranges (channels), and an accumulated distribution is drawn for weight or volume from the small size side. The particle diameter at an accumulation of 50% is defined as a weight average particle diameter or a volume average particle diameter.

Method for Determining Shape Factor

Herein, the shape factor SF1 is determined by the following formula.

$$SF1=100\pi\times(ML)^2/(4\times A)$$

wherein ML represents the maximum length of the particles and A represents the projected area of the particles. The maximum length and the projected area of the particles are determined in such a manner that the particles sampled on slide glass are observed with an optical microscope, and the image is input for image analysis to an image analyzer (LUZEX III, manufactured by Nireco Corporation) through a video camera. The number of the sampled particles is equal to or more than 100, and the shape factor SF1 is calculated by using the average value according to the above formula.

Measurement of Glass Transition Point of Resin Particles or Resin in Resin Dispersion The glass transition temperature Tg of the resin is measured using a differential scanning calorimeter (DSC50, manufactured by Shimadzu Corporation).

Evaluation Methods

Using each of the developers prepared in Examples and Comparative Examples above, images are printed on recording paper with a modified machine of DOCUCENTRE COLOR 400 (manufactured by Fuji Xerox Office Supply, P paper). Specifically, the charge/charge decay is evaluated by printing images having an image density of 20% on 100 sheets under the condition of 25° C./80% RH, subsequently printing images having an image density of 1% on 10,000 sheets, and then printing images having an image density of 20% on 100 sheets. The charging is conducted to the images having an image density of 20% before the printing of 10,000 sheets (initial) and after the printing of 10,000 sheets (after 10,000 sheets), and the presence or absence of fogging and white streaks (image quality evaluation) with the first sheet after being left to stand for 24 hours is evaluated visually. The charging is measured using TB-200 (manufactured by Toshiba Chemical Corporation). The sample after being left to stand for 24 hours is left to stand as it is after the printing of the 10,000$^{th}$ sheet, and after 24 hours, sampling is conducted from a developing device and the charging is evaluated.

The filming is evaluated by continuously printing thin line images having an image density of 1% on 10,000 sheets in the environment of 10° C./20% RH, and at this time, the image quality and the state of the photoreceptor are evaluated. The evaluation criteria for the filming are shown below.

G1: There is no adherence on the photoreceptor.

G2: There is adherence in the form of spots on the photoreceptor, but there is no problem in the image.

G3: Adherence in the form of a streak shape is generated partly on the photoreceptor, but there is no problem in the image.

G4: Adherence in the form of a streak shape is generated on the entire surface of the photoreceptor, and image quality defects are generated.

G5: There is strong adherence on the entire surface of the photoreceptor, and image quality defects are generated.

The evaluation results are summarized in Table 2.

TABLE 1

| | | Treatment agent 1 | | Treatment agent 2 | |
|---|---|---|---|---|---|
| | Inorganic particles | Kind | Treatment amount (parts) | Kind | Treatment amount (parts) |
| External treatment additive 1 | Silica | HMDS | 10 | Perfluoropolyether | 20 |
| External treatment additive 2 | Silica | HMDS | 10 | Perfluoropolyether | 28 |
| External treatment additive 3 | Silica | HMDS | 10 | Perfluoropolyether | 2 |
| External treatment additive 4 | Silica | HMDS | 10 | Hexafluoropropylene epoxide | 20 |
| External treatment additive 5 | Silica | HMDS | 10 | Chlorotrifluoroethylene | 20 |
| External treatment additive 6 | Silica | Dimethyldimethoxy silane | 10 | Perfluoropolyether | 20 |
| External treatment additive 7 | Titania | HMDS | 10 | Perfluoropolyether | 20 |
| External treatment additive 8 | Titania | Dimethyldimethoxy silane | 10 | Perfluoropolyether | 20 |
| External treatment additive 9 | Silica | HMDS | 10 | Dimethylsilicone | 20 |
| External treatment additive 10 | Titania | HMDS | 10 | Dimethylsilicone | 20 |
| External treatment additive 11 | Silica | None | — | Perfluoropolyether | 20 |
| External treatment additive 12 | Silica | HMDS | 10 | None | — |
| External treatment additive 13 | Titania | HMDS | 10 | None | — |

TABLE 2

| | | | Charging (μC/g) | | | | |
|---|---|---|---|---|---|---|---|
| | External treatment additive | Toner mother particles | Initial | After printing of 10,000 sheets | After being left for 24 hours | Filming evaluation | Image quality evaluation |
| Ex. 1 | 1 | 1 | 72.2 | 67.8 | 65.1 | G2 | No problem |
| Ex. 2 | 2 | 1 | 65.8 | 62.3 | 59.5 | G1 | No problem |
| Ex. 3 | 3 | 1 | 78.3 | 75.1 | 68.9 | G2 | No problem |
| Ex. 4 | 4 | 1 | 64.3 | 62.0 | 58.0 | G2 | No problem *2 |
| Ex. 5 | 5 | 1 | 60.9 | 58.1 | 51.0 | G3 | No problem *1 |
| Ex. 6 | 6 | 1 | 68.5 | 60.1 | 58.6 | G1 | No problem |
| Ex. 7 | 7 | 1 | 50.8 | 48.5 | 43.5 | G3 | No problem *1 |
| Ex. 8 | 8 | 1 | 48.8 | 45.6 | 42.8 | G3 | No problem *1 |
| Ex. 9 | 1 | 2 | 42.8 | 40.4 | 37.3 | G2 | No problem *2 |
| Comp. Ex. 1 | 9 | 1 | 64.8 | 78.8 | 34.9 | G1 | Presence of Fogging (after being left to stand) |
| Comp. Ex. 2 | 10 | 1 | 45.0 | 40.5 | 24.2 | G2 | Presence of Fogging (after being left to stand) |
| Comp Ex. 3 | 11 | 1 | 55.3 | 52.1 | 39.9 | G1 | Presence of Fogging (after being left to stand) |
| Comp. Ex. 4 | 12 | 1 | 60.5 | 57.6 | 55.9 | G5 | Presence of White Streaks |
| Comp. Ex. 5 | 13 | 1 | 48.9 | 40.3 | 34.5 | G4 | Presence of White Streaks |

TABLE 2-continued

| | External treatment additive | Toner mother particles | Charging (μC/g) Initial | After printing of 10,000 sheets | After being left for 24 hours | Filming evaluation | Image quality evaluation |
|---|---|---|---|---|---|---|---|
| Comp. Ex. 6 | 9 | 2 | 45.7 | 60.8 | 30.8 | G1 | Presence of Fogging (after being left to stand) |

Furthermore, *1 and *2 in Table 2 mean the following.

*1: Slight white streaks are seen, but there is no problem in the image quality.

*2: Slight fogging is seen, but there is no problem in the image quality.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner for developing an electrostatic charge image comprising:

toner particles containing a colorant, a binder resin, and a release agent; and an external additive that contains inorganic particles having hydrophobization-treated surfaces and a fluorine atom-containing oil on the hydrophobization-treated surfaces, wherein an amount of the fluorine atom-containing oil is from 7% to 30% by weight with respect to a total weight of the external additive, a weight ratio of the hydrophobization treatment agent to the fluorine atom-containing oil is in a range of 1:30 to 50:1, the inorganic particles are treated with the fluorine atom-containing oil prior to incorporation of the external additive into the toner, and the fluorine atom-containing oil is selected from perfluoropolyether, polyhexafluoropropylene epoxide, polychlorotrifluoroethylene, polytetrafluoroethylene, and perfluorocarbon.

2. The toner for developing an electrostatic charge image according to claim 1, wherein an amount of the hydrophobization treatment agent in the hydrophobization treatment is in a range of 1 part by weight to 50 parts by weight with respect to 100 parts by weight of the inorganic particles.

3. The toner for developing an electrostatic charge image according to claim 1, wherein a volume average primary particle diameter of the inorganic particles is in a range of 3 nm to 500 nm.

4. The toner for developing an electrostatic charge image according to claim 1, wherein a volume average primary particle diameter of the inorganic particles is in a range of 7 nm to 300 nm.

5. The toner for developing an electrostatic charge image according to claim 1, wherein a content of the inorganic particles is in a range of 0.3% by weight to 10% by weight with respect to the total weight of the toner.

6. The toner for developing an electrostatic charge image according to claim 1, wherein the toner particles contain a crystalline polyester resin in a range of 2% by weight to 30% by weight with respect to a weight of the toner particles.

7. An electrostatic charge image developer comprising:

the toner according to claim 1; and a carrier.

8. A toner cartridge containing the toner according to claim 1.

9. A developer cartridge containing the developer according to claim 7.

10. A process cartridge for an image forming apparatus, having a developer holding member that holds and transports an electrostatic charge image developer, wherein the developer is the electrostatic charge image developer according to claim 7.

11. An image forming apparatus comprising:

an image holding member;

a charging unit that charges a surface of the image holding member;

a latent image forming unit that forms an electrostatic latent image on the surface of the image holding member;

a developing unit that contains the electrostatic charge image developer according to claim 7 and develops the electrostatic latent image formed on the surface of the image holding member using the developer to form a toner image; and a transfer unit that transfers the developed toner image onto a transfer medium.

12. An image forming method comprising:

charging a surface of an image holding member;

forming an electrostatic latent image on the surface of the image holding member;

developing the electrostatic latent image formed on the surface of the image holding member using a developer to form a toner image; and transferring the developed toner image onto a transfer medium, wherein the developer is the electrostatic charge image developer according to claim 7.

* * * * *